US006361655B1

(12) United States Patent
Holopainen et al.

(10) Patent No.: US 6,361,655 B1
(45) Date of Patent: Mar. 26, 2002

(54) BEAM STRUCTURE IN A PULP MACHINE/ PAPER MACHINE/BOARD MACHINE OR IN A PAPER/BOARD FINISHING DEVICE

(75) Inventors: Kari Holopainen, Muurame; Ilkka Rata, Jyväskylä; Jukka Samppala, Jyväskylä; Juha Isometsä, Jyväskylä; Heikki Toivanen, Muurame, all of (FI)

(73) Assignee: Valmet Corporation, Helsinki (FI)

( * ) Notice: Subject to any disclaimer, the term of this patent is extended or adjusted under 35 U.S.C. 154(b) by 0 days.

(21) Appl. No.: 09/425,333

(22) Filed: Oct. 22, 1999

(30) Foreign Application Priority Data

Oct. 23, 1998 (FI) ..... 982294

(51) Int. Cl.[7] ..... B21G 3/00; B05C 3/00; B21C 43/00

(52) U.S. Cl. ..... 162/281; 118/126; 118/261; 118/413; 15/256.5; 15/256.51; 101/157; 101/169

(58) Field of Search ..... 162/281, 111; 118/126, 261, 413; 15/256.51, 256.5; 101/157, 169, 365

(56) References Cited

U.S. PATENT DOCUMENTS

| | | | | | |
|---|---|---|---|---|---|
| 3,121,904 | A | * | 2/1964 | Scott | 15/308 |
| 3,387,317 | A | * | 6/1968 | Noyer et al. | 15/256.51 |
| 4,185,399 | A | * | 1/1980 | Gladish | 34/120 |
| 4,558,658 | A | * | 12/1985 | Sommer et al. | 118/411 |
| 5,356,519 | A | * | 10/1994 | Grabscheid et al. | 162/281 |
| 5,858,090 | A | * | 1/1999 | Gottwald | 118/119 |
| 5,904,775 | A | * | 5/1999 | Salo et al. | 118/413 |
| 5,993,548 | A | * | 11/1999 | Madrzak et al. | 118/123 |

FOREIGN PATENT DOCUMENTS

| | | | |
|---|---|---|---|
| DE | 91135427 | * | 7/1992 |
| FI | 98233 | * | 1/1997 |

* cited by examiner

*Primary Examiner*—Jose Fortuna
(74) *Attorney, Agent, or Firm*—Steinberg & Raskin, P.C.

(57) ABSTRACT

A beam structure (10) made of a composite for a pulp machine/paper machine/board machine or for a paper/board finishing device. The beam (10, 10$a_1$, 10$a_2$) is formed of a first curved part (12) and of a second straight part (13) joined thereto, to which second straight part (13) a doctoring, coating or measurement apparatus (110) is attached.

9 Claims, 2 Drawing Sheets

FIG. 1 A
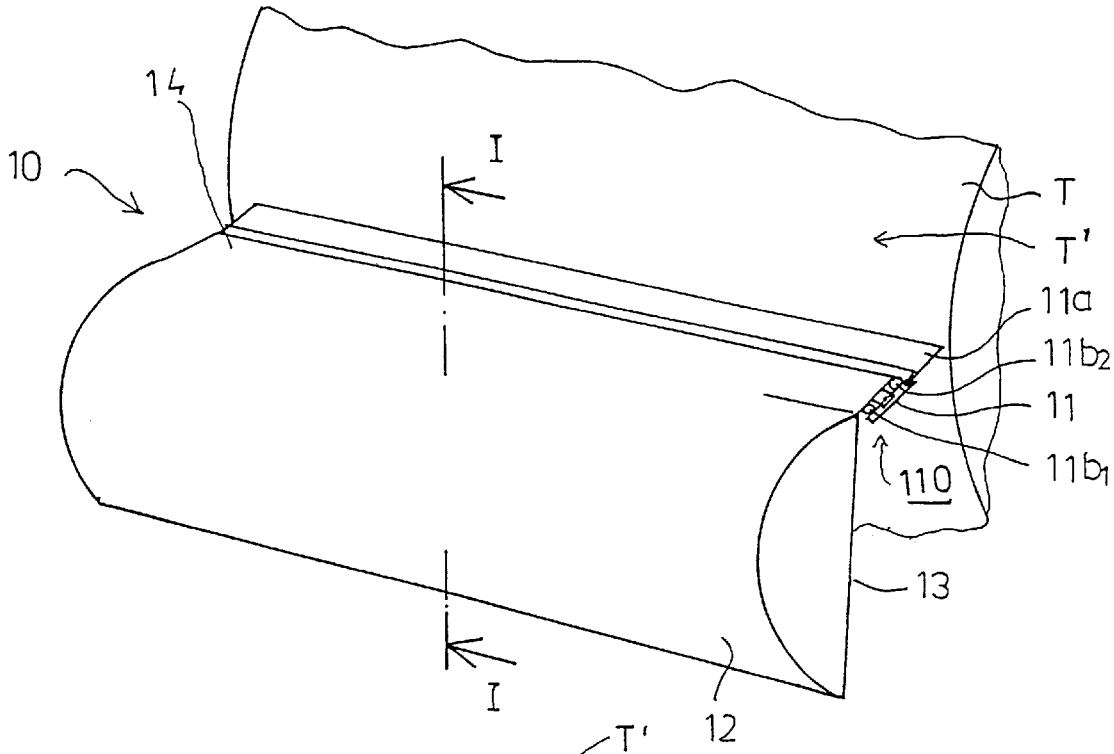
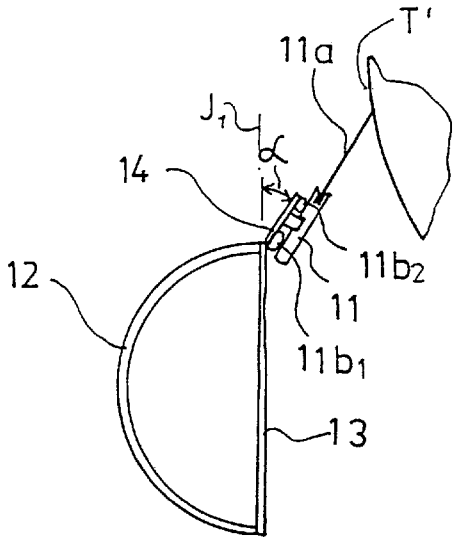
FIG. 1 B

BEAM STRUCTURE IN A PULP MACHINE/ PAPER MACHINE/BOARD MACHINE OR IN A PAPER/BOARD FINISHING DEVICE

FIELD OF THE INVENTION

The present invention relates to a beam structure in a pulp machine, paper machine, board machine or a paper/board finishing device.

BACKGROUND OF THE INVENTION

With regard to the prior art, reference is made to the following publications FI 925655 and DE G 91 13 542.7.

Thus, composite beam structures of a paper machine are known from the prior art. The doctor beam in one prior-art arrangement is a structure having a triangular cross-section and comprises corner pieces to which side plates are attached. The side plates are advantageously made of a composite material. Nonetheless, prior art structures have certain inherent limitations and shortcomings.

OBJECTS AND SUMMARY OF THE INVENTION

Accordingly, it is an object of the present invention to provide an improved composite beam structure for use in a paper machine, board machine or paper/board finishing device.

It is another object of the present invention to provide an improved composite beam structure that is simple in construction and inexpensive to manufacture.

It is a further object of the present invention to provide an improved composite beam structure that overcomes the shortcomings of the prior art.

In accordance with the objects of the invention, a composite beam structure is provided, the beam being suitable for use in connection with a pulp machine, board machine or paper/board finishing device. The beam includes two parts, a first semicircular part and a second strait plate-shaped portion, to which the first portion is joined. The semicircular part is advantageously made by cutting the same from a tube constructed from a fiber tape material using a pultrusion, or pultrusion method. A plate made, for example, by lamination is fixed to the semicircular part. The end of the plate is at an angle with respect to the rest of the plate frame. The angle is chosen so as to be suitable for the location of use. A holder is further attached to the laminated plate, to which holder are also attached means to be placed against the face of a roll for cleaning the roll face or for applying a coating material, or measurement devices in which connection the beam serves as a measuring beam. In addition to lamination, the straight plate portion can also be made by extrusion or by pultrusion. The composite structure provides the following advantages:

- no thermal insulation is needed for preventing thermal warping,
- the natural frequency of the beam is higher than that of steel with the same dimensions, with the result that the beam is smaller,
- oscillation of the beam is easier at higher frequencies because of the small mass of the beam,
- smaller deflection because of the beam's own weight, in which case there is no need for so-called "crowning" of the head.

The invention will be described in detail with reference to some preferred embodiments of the invention illustrated in the accompanying drawings. However, the invention is not confined to the illustrated embodiments alone.

BRIEF DESCRIPTION OF THE INVENTION

Additional objects of the invention will be apparent from the following description of the preferred embodiment thereof taken in conjunction with the accompanying non-limiting drawings in which:

FIG. 1A is an axonometric view illustrating a beam made of a composite in accordance with the invention.

FIG. 1B shows a cross-section I—I of the beam structure shown in FIG. 1A.

DETAILED DESCRIPTION OF THE INVENTION

Figure 2:
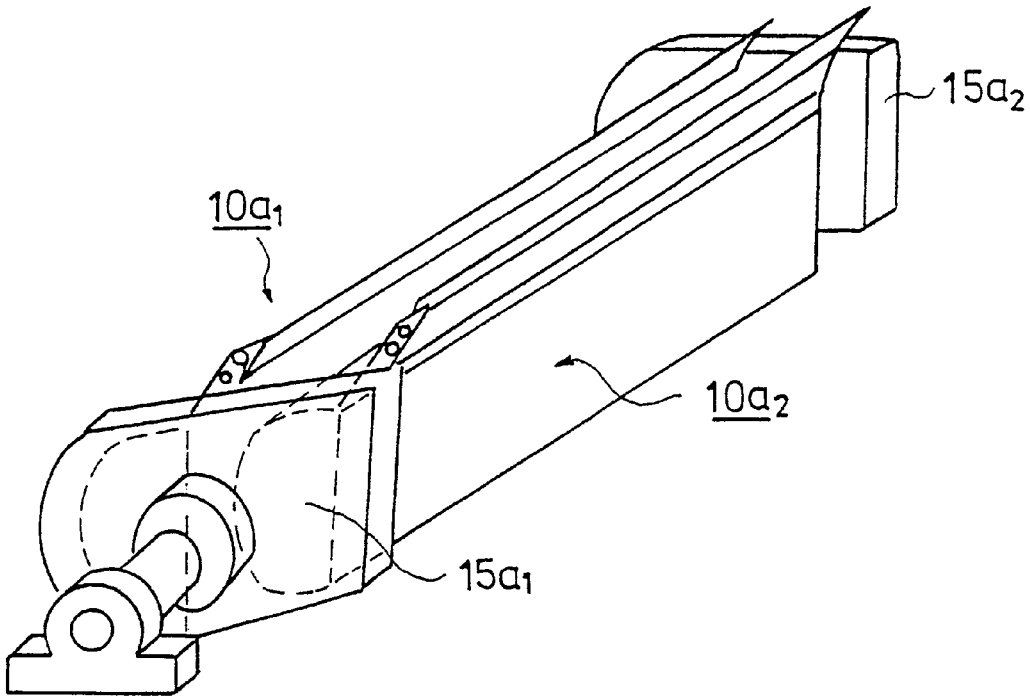
FIG. 2 shows an embodiment of the beam in accordance with the invention, in particular for a doctor application, where two beams are formed into a double doctor structure.

Referring to FIGS. 1–2 wherein like reference numerals refer to the same or similar elements, the doctor beam in accordance with the invention will be described.

FIG. 1A, is an axonometric view of a beam 10 made of a composite in accordance with the invention in connection with a roll T. The beam 10 is provided with means 110 for maintaining the roll or for coating a web or for measuring a web/felt/wire. In the embodiment of FIG. 1A, the beam 10 serves as a doctor beam, and the means 110 comprise a blade holder 11 and a blade 11*a* attached thereto, which blade is arranged to maintain the roll face T' of the roll T, for example, the face of a center roll in a press section of a paper machine, or to apply a coating slip to the face of a paper web or to the face of the roll. As shown in the figure, the beam structure comprises a first curved beam portion 12 and a straight plate-shaped beam portion 13 joined thereto. The beam 10 is advantageously a composite structure, being preferably formed, for example, of carbon fibers.

FIG. 1B shows the section I—I from FIG. 1A. As shown in the figure, the beam 10 thus advantageously comprises the semicircular first beam portion 12, which is cut from a circular blank, for example, from a tube made from fiber by winding. The straight doctor beam portion 13 is advantageously made by laminating, for example, carbon fibre layers one upon the other or said straight doctor beam portion 13 can be made by extruding fiber and/or a synthetic polymer material through an extruder to obtain a desired shape. The beam portions 12 and 13 are joined to each other by hot welding or by a glue line. At the end of the second straight beam portion 13 there is an end visor, or an edge 14, which is at an angle $\alpha$ with respect to the plane $J_1$ of the straight portion, the holder 11 being further attached to said visor-shaped edge 14, the blade 11*a* being further attached to said holder in a conventional manner. The blade holder 11 comprises further in its connection loading hoses $\mathbf{11}b_1$, $\mathbf{11}b_2$ as a loading means.

Instead of the blade 11*b*, coating means, for example, coating supports, or measurement devices for measuring, for example, a web/felt/wire may be attached to the beam.

FIG. 2 is an axonometric view of an inventive embodiment of a so-called double doctor structure. There are two beams $\mathbf{10}a_1$ and $\mathbf{10}a_2$ in accordance with the preceding figures. They are placed between end plates $\mathbf{15}a_1$ and $\mathbf{15}a_2$ and they are structured and arranged to be turnable with respect to the end plates $\mathbf{15}a_1$ and $\mathbf{15}a_2$ separately independently of each other. Thus, by using fiber composite beams $\mathbf{10}a_1$, $\mathbf{10}a_2$ of carbon fibre construction, the double doctor may also be made very lightweight in structure. Additionally, the double doctor in accordance with the invention can be readily regulated and it occupies little space, thereby avoiding space problems.

What is claimed is:

1. A beam structure (10) made of a composite for a pulp, paper or board machine or for a paper or board finishing device, the beam (10, 10$a_1$, 10$a_2$) comprising;

a first curved beam portion (12) made up of a wound carbon fiber material, said first curved beam portion (12) having a pair of axially extending terminal edges; and a second straight beam portion (13) having a planar surface to which each of said pair of axially extending terminal edges of said first curved beam portion (12) is joined, said second straight beam portion (13) comprising one of doctoring, coating or measurement means (110) attached thereto.

2. A beam structure as claimed in claim 1, wherein the first curved beam portion (12) of the beam (10) is semicircular.

3. A beam structure as claimed in claim 1, wherein the second beam portion (13) is a straight plate-shaped part.

4. A beam structure as claimed in claim 1, further comprising an end visor (14) attached to said second straight beam portion (13), said visor (14) being at an angle ($\alpha$) with respect to a planar surface ($J_1$) of said second straight beam portion.

5. A beam structure as claimed in claim 4, further comprising a holder (11) of a blade (11*a*) with loading devices (11$b_1$, 11$b_2$) attached to the end visor (14).

6. A beam structure as claimed claim 1, wherein the straight beam portion (13) is made by laminating fibre layers one upon the other, and wherein the curved beam portion (12) is made by cutting said curved beam portion (12) from a tube blank, which tube blank is formed by winding fibre layers one upon the other.

7. A beam structure as claimed in claim 1, wherein the first curved beam portion (12) is joined to the second straight beam portion (13) by a glue line or by hot welding.

8. A beam structure as claimed in claim 1, further comprising a second beam (10$a_2$) having a curved beam portion made up of a wound carbon fiber material, said curved beam portion having a pair of axially extending terminal edges, and a straight beam portion having a planar surface to which each of said pair of axially extending terminal edges of said curved beam portion is joined, said straight beam portion comprising one of doctoring, coating or measurement means (110) attached thereto, each of said beams being fitted between a pair of common end plates (15$a_1$, 15$a_2$) to form a double doctor structure.

9. A beam structure as claimed in claim 8, wherein the doctor beams (10$a_1$, 10$a_2$) of the double doctor are structured and arranged to be independently turnable of each other with respect to said pair of common end plates (15$a_1$, 15$a_2$).

* * * * *